US007017829B2

(12) United States Patent
Martens, III et al.

(10) Patent No.: US 7,017,829 B2
(45) Date of Patent: Mar. 28, 2006

(54) ATOMIZER WICKING SYSTEM

(75) Inventors: Edward J. Martens, III, Racine, WI (US); Scott D. Walter, Twin Lakes, WI (US); Thomas A. Helf, New Berlin, WI (US); David A. Tomkins, Racine, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 10/412,911

(22) Filed: Apr. 14, 2003

(65) Prior Publication Data

US 2004/0200907 A1 Oct. 14, 2004

(51) Int. Cl.
*B05B 1/28* (2006.01)

(52) U.S. Cl. ..... 239/44; 239/326; 239/338

(58) Field of Classification Search ..... 239/44, 239/326, 338, 120.2; 310/326, 327
See application file for complete search history.

(56) References Cited

U.S. PATENT DOCUMENTS

| | | | | |
|---|---|---|---|---|
| 4,301,093 | A | | 11/1981 | Eck |
| 4,334,531 | A | | 6/1982 | Reichi et al. |
| 4,474,326 | A | | 10/1984 | Takahashi |
| 4,582,654 | A | | 4/1986 | Karnicky et al. |
| 4,753,579 | A | | 6/1988 | Murphy |
| 4,790,479 | A | | 12/1988 | Matsumoto et al. |
| 4,812,241 | A | | 3/1989 | Shafer |
| 5,124,200 | A | | 6/1992 | Mallonee |
| 5,164,740 | A | | 11/1992 | Ivri |
| 5,518,179 | A | * | 5/1996 | Humberstone et al. .. 239/102.2 |
| 5,529,055 | A | | 6/1996 | Gueret |
| 5,657,926 | A | * | 8/1997 | Toda ..... 239/102.2 |
| 5,863,196 | A | | 1/1999 | Rockwell et al. |
| 5,938,117 | A | | 8/1999 | Ivri |
| 6,085,740 | A | | 7/2000 | Ivri et al. |
| 6,293,474 | B1 | * | 9/2001 | Helf et al. ..... 239/102.2 |
| 6,296,196 | B1 | * | 10/2001 | Denen et al. ..... 239/4 |
| 6,341,732 | B1 | | 1/2002 | Martin et al. |
| 6,378,780 | B1 | | 4/2002 | Martens, III et al. |
| 6,382,522 | B1 | * | 5/2002 | Tomkins et al. ..... 239/102.2 |
| 6,386,462 | B1 | | 5/2002 | Martens, III |
| 6,439,474 | B1 | * | 8/2002 | Denen ..... 239/102.2 |
| 6,446,880 | B1 | | 9/2002 | Schram et al. |
| 6,450,419 | B1 | | 9/2002 | Martens, III et al. |
| 6,467,476 | B1 | | 10/2002 | Ivri et al. |
| 6,843,430 | B1 | * | 1/2005 | Boticki et al. ..... 239/102.1 |

FOREIGN PATENT DOCUMENTS

| | | |
|---|---|---|
| EP | 0 897 755 A2 | 2/1999 |
| EP | 1 236 517 A1 | 9/2002 |
| EP | 1 273 355 A1 | 1/2003 |
| GB | 845 639 A | 8/1960 |
| WO | WO 02/068128 A2 | 9/2002 |
| WO | WO 03/068412 A1 | 8/2003 |

* cited by examiner

*Primary Examiner*—Hoang Nguyen

(57) ABSTRACT

A replacement reservoir assembly (30) for an atomizing device (20), which uses a vibratable orifice plate (37) for atomizing liquid, includes a container (31), which contains a liquid to be atomized, and an elongated wick (56) having a lower end which is immersed in the liquid within the container (31) and an upper end located above the container (31). The wick (56) includes a dimensionally stable material having capillary passages for drawing liquid out of the container (31) to the upper end of the wick (56), which is outside the container (31). The upper end of the wick (56) has at least one surface that is configured to provide an unobstructed passage to the atmosphere from a region between a top surface of the wick (56) and a facing surface of the vibratable orifice plate (37) when the replacement reservoir is positioned in the atomizing device (20). A wick (56) for use in a replaceable reservoir assembly (30) that contains liquid to be atomized by a vibratory orifice plate (37) and a method of positioning an upper end of a solid, dimensionally stable wick (56) are also disclosed.

21 Claims, 5 Drawing Sheets

ATOMIZER WICKING SYSTEM

BACKGROUND OF THE INVENTION

1. Field of the Invention

This invention relates to the atomization of liquids and more particularly it concerns novel methods and apparatus for supplying liquid to be atomized to a surface of an orifice plate which, upon vibration, atomizes the liquid and ejects minute droplets of the liquid from its opposite surface.

2. Description of the Related Art

Atomizers of the type to which the present invention relates use a vibration orifice plate or membrane to atomize liquid which is brought to one side of the plate by a pliant wick which presses against the plate. An example of such an atomizer is shown in U.S. Pat. No. 6,450,419.

Atomizing devices that use wicks or conduits of various types to deliver liquids to a vibratory atomizing element are disclosed in U.S. Pat. Nos. 6,467,476, 6,085,740, 5,529,055, 4,790,479, 4,753,579, 4,334,531 and U.S. Pat. No. 4,301,093 and published European Patent Application EP 0 897 755 A2. U.S. Pat. Nos. 4,582,654 and 4,474,326 describe the use of tubes or needles to deliver a liquid to be atomized. U.S. Pat. Nos. 5,863,196 and 5,124,200 describe wicks.

Our invention solves a problem which occurs when a solid, dimensionally stable wick is used to convey the liquid to be atomized to the orifice plate. An example of an atomizing device which uses a solid, dimensionally stable wick is shown and described in U.S. patent application Ser. No. 10/154,509, filed May 24, 2002, assigned to the assignee of this invention and incorporated herein by reference. Such wicks are generally made of plastic and contain interstices or capillary passages, which extend therethrough from one end to the other to draw liquids up through the wick from one end of the wick to its other end. It has been found that when the wick of a replacement reservoir is positioned against an orifice plate that is still wet from the wick of a previous reservoir, it is often difficult to restart the atomizing operation. It may take hours or even days for the atomizing operation to restart, which adversely affects the use of the atomizer.

Accordingly, we found a need in the art for an atomization device that is "self priming," meaning that the wick included in the atomization device reliably and instantaneously delivers fluid to a piezoelectric pump.

SUMMARY OF THE INVENTION

Our invention improves the delivery of fluid to a vibrating-orifice-plate atomizer when a replacement reservoir containing a new, dimensionally stable wick is mounted in the atomizer.

According to one aspect, our invention provides a method of positioning an upper end of a solid, dimensionally stable wick having liquid-filled interstices against a surface of a vibratable orifice plate, which has a plurality of minute orifices formed therethrough and is configured to dispense the liquid filling the interstices of the wick as the orifice plate vibrates. The method comprises the step of moving the wick toward the vibratable orifice plate while maintaining a liquid-free passage that extends to the atmosphere from a space between the upper end of the wick and the surface of the orifice plate as the wick is positioned with a portion of the upper end contacting the orifice plate.

According to another aspect, our invention provides a wick for use in a replaceable reservoir assembly that contains liquid to be atomized by a vibratory orifice plate, which has a plurality of minute orifices formed therethrough and is configured to dispense the liquid in the reservoir assembly. The wick comprises a dimensionally stable material having capillary passages for drawing a liquid from a lower end to an upper end. The wick has different levels at the upper end that are configured to provide an unobstructed passage to the atmosphere from a region between a top surface of the wick and a facing surface of the vibratory orifice plate.

According to a still further aspect, our invention provides a replacement reservoir assembly for an atomizing device, which uses a vibratable orifice plate for atomizing liquid. The replacement reservoir assembly comprises a container, which contains a liquid to be atomized, and an elongated wick having a lower end which is immersed in the liquid within the container and an upper end located above the container. The wick comprises a dimensionally stable material having capillary passages for drawing liquid out of the container to the upper end of the wick, which is outside the container. The upper end of the wick has at least one surface that is configured to provide an unobstructed passage to the atmosphere from a region between a top surface of the wick and a facing surface of the vibratable orifice plate when the replacement reservoir is positioned in the atomizing device.

According to yet another aspect, our invention provides a wick for use in a replaceable reservoir that contains liquid to be atomized by a vibratory orifice plate. The orifice plate has a plurality of minute orifices formed therethrough and is configured to dispense the liquid in the reservoir. The wick comprises a dimensionally stable material having capillary passages for drawing a liquid from a lower end to an upper end, and a cutout having side surfaces depending from the top surface of the wick and a bottom surface being disposed below the top surface of the wick such that the bottom surface does not contact the vibratory orifice plate, with the cutout composing the unobstructed passage.

DETAILED DESCRIPTION OF THE PREFERRED EMBODIMENTS

Figure 1:
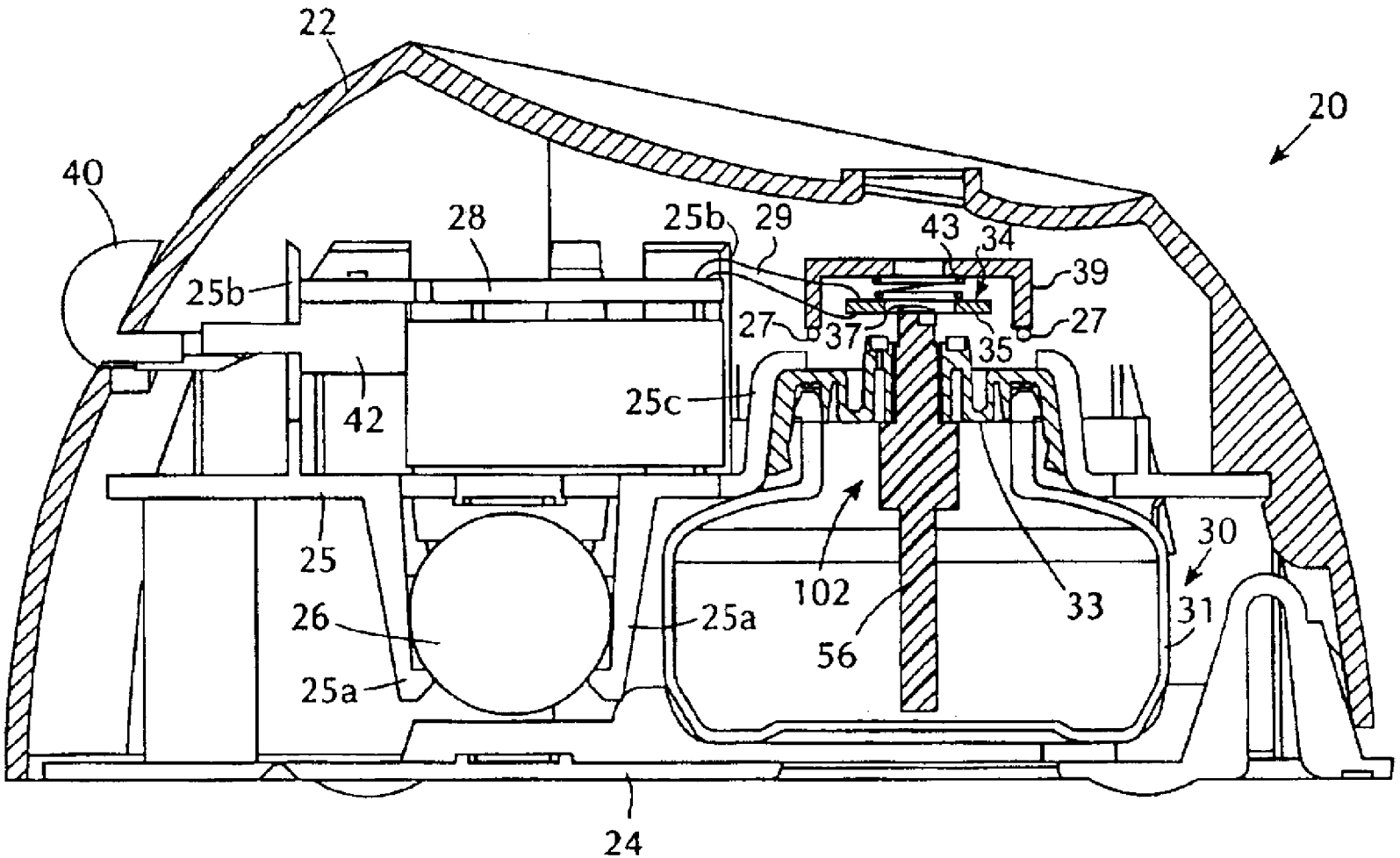
FIG. 1 is an elevational cross section of an atomizer device embodying the invention.

An atomization device 20 according to our invention generally comprises an atomizer assembly 34, which includes an orifice plate 37, and a replaceble reservoir assembly 30. The reservoir assembly 30 includes a reservoir 31 containing fluid and a wick 56. When one reservoir assembly 30 is removed by a user and replaced with another reservoir assembly, the wick 56 instantaneously delivers fluid to the orifice plate 37, thus greatly improving the atomization device 20.

As shown in FIG. 1, the piezoelectrically actuated atomization device 20 according to a preferred embodiment of our invention comprises a housing 22 formed as a hollow plastic shell and closed by a flat bottom wall 24. A horizontal platform 25 extends across the interior of the housing 22. A battery 26 is supported by means of support prongs 25*a* which extend down from the underside of the platform 25 inside the housing 22. In addition, a printed circuit board 28 is supported on support elements 25*b* which extend upwardly from the platform 25. A liquid reservoir assembly 30 is replaceably mounted to the underside of a dome-like formation 25*c* on the platform 25.

The liquid reservoir assembly 30 comprises a liquid container 31 for holding a liquid to be atomized, a plug 33, which closes the top of the container, and the wick 56, which extends from within the liquid container 31 through the plug 33, to a location above the liquid container 31. The plug 33 is constructed to allow removal and replacement of the complete liquid reservoir assembly 30 from the underside of the dome-like formation 25*c* on the platform 25. Preferably, the plug 33 and the platform are formed with a bayonet attachment (not shown) for this purpose. When the replaceable liquid reservoir assembly 30 is mounted on the platform 25, the wick 56 extends up through a center opening in the dome-like formation 25*c*. The wick 56, which is described in greater detail hereinafter, operates by capillary action to deliver liquid from within the liquid container 31 to a location just above the dome-like formation 25*c* on the platform 25.

Figure 2:
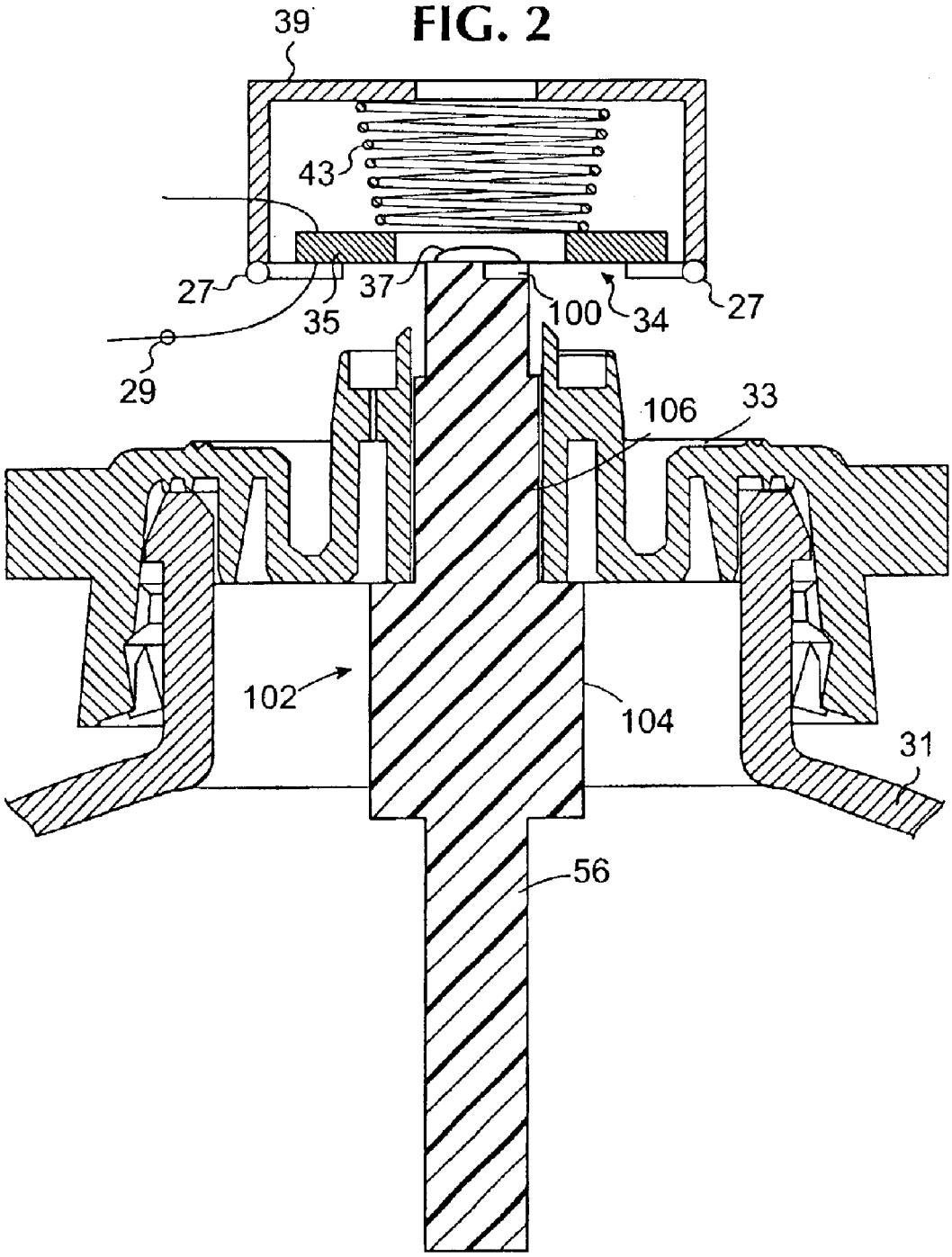
FIG. 2 is an enlarged fragmentary cross section, taken in elevation, of the upper portion of a replacement reservoir together with a vibratory-orifice-plate atomizing arrangement used in the atomizing device of FIG. 1.
Figure 12:
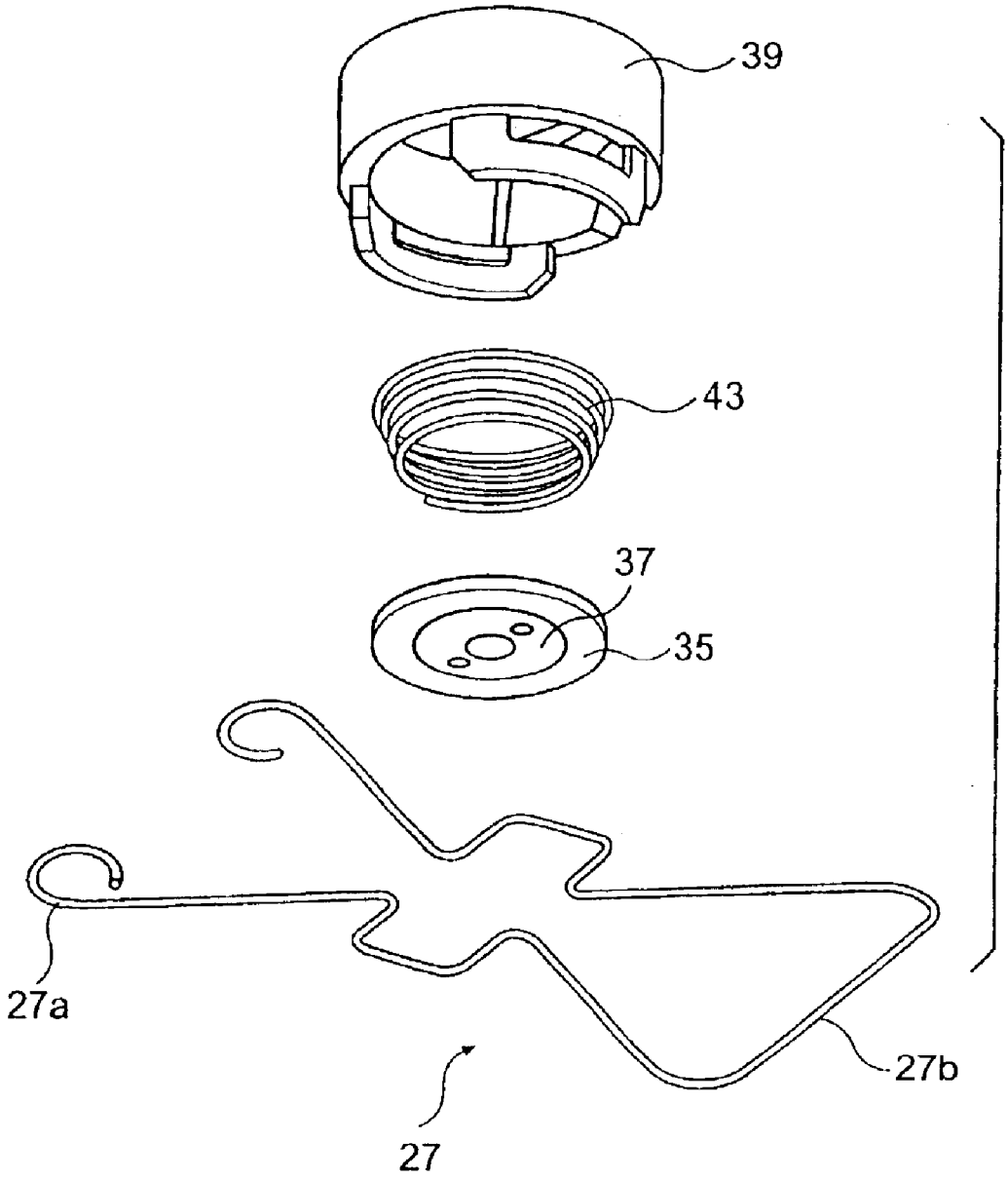
FIG. 12 is an exploded view of components of the atomization device.

An atomizer assembly 34 is supported on the platform 25 in cantilever fashion by means of a resilient, elongated wire-like support 27. As is described more fully in copending U.S. patent application Ser. No. 10/304,215, filed Nov. 26, 2002, assigned to the assignee of this invention and incorporated herein by reference, in the preferred embodiment, the wire-like support 27 is attached at its ends 27*a*, 27*b*, shown in FIG. 12, to posts, which protrude upward from the platform 25. As shown in FIGS. 1, 2 and 12, the support 27 is shaped such that it resiliently supports the lower surface of the orifice plate 37 and a spring housing 39, while a spring 43 resiliently presses on the upper surface of the orifice plate 37. (Rather than press on the orifice plate 37 itself, the spring 43 may alternatively or additionally press on a member, such as an actuator element 35, discussed below, which is connected to the orifice plate 37.) Together, the support 27 and the spring 43 hold the orifice plate 37 in place in a manner that allows the orifice plate 37 to move up and down against the resilient bias of the wire-like support 27.

Other ways of supporting the atomizer assembly 34, in addition to the foregoing, are possible, and another such way is disclosed in U.S. patent application Ser. No. 10/154,509, filed May 24, 2002, noted above.

The atomizer assembly 34 comprises an annularly shaped piezoelectric actuator element 35 and the circular orifice plate 37, which extends across and is soldered or otherwise affixed to the actuator element 35. A construction of a vibrator type atomizer assembly is per se well known and is described, for example, in U.S. Pat. No. 6,296,196, which is incorporated herein by reference. Accordingly, the atomizer assembly 34 will not be described in detail except to say that when alternating voltages are applied to the opposite upper and lower sides of the actuator element 35 these voltages produce electrical fields across the actuator element and cause it to expand and contract in radial directions. This expansion and contraction is communicated to the orifice plate 37 causing it to flex so that a center region thereof vibrates up and down. The center region of the orifice plate 37 is domed slightly upward to provide stiffness and to enhance atomization. The center region is also formed with a plurality of minute orifices which extend through the orifice plate 37 from the lower or under surface of the orifice plate 37 to its upper surface. A flange is provided around the center region of the dome.

In operation, the battery 26 supplies electrical power to circuits on the printed circuit board 28 and these circuits convert this power to high frequency alternating voltages. A suitable circuit for producing these voltages is shown and described in U.S. Pat. No. 6,296,196 noted above. As described in that patent, the device may be operated during successive on and off times. The relative durations of these on and off times can be adjusted by an external switch actuator 40 on the outside of the housing 22 and coupled to a switch element 42 on the printed circuit board 28.

When the atomizer assembly 34 is supported by the support member 27, the flange of the orifice plate 37 is positioned in contact with the upper end of the wick 56. The atomizer assembly 34 is thereby supported above the liquid reservoir assembly 30 such that the upper end of the wick 56 touches the underside of the orifice plate 37, as shown in FIG. 2. Thus, the wick 56 delivers liquid from within the liquid reservoir 31 by capillary action to the underside of the orifice plate 37, which upon vibration, causes the liquid to pass through its orifices and be ejected from its opposite side (i.e., the upper surface) in the form of very small droplets.

It will be appreciated from the foregoing that the horizontal platform 25 serves as a common structural support for both the liquid reservoir assembly 30 and the atomizer assembly 34. Thus, the horizontal platform maintains the liquid reservoir assembly 30, and particularly, the upper end of the wick 56, in alignment with the orifice plate 37 of the atomizer assembly 34. Moreover, because the atomizer assembly 34 and the orifice plate 37 are resiliently mounted, the upper end of the wick 56 will always press against the under surface of the orifice plate 37 and/or the actuator element 35 irrespective of dimensional variations which may occur due to manufacturing tolerances when one liquid reservoir is replaced by another. This is because if wick 56 of the replacement liquid reservoir assembly 30 is higher or lower than the wick 56 of the original liquid reservoir assembly 30, the action of the spring 43 will allow the orifice plate 37 to move up and down according to the location of the wick 56 in the replacement reservoir assembly 30, so that the wick 56 will always press against the underside of the orifice plate 37 and/or the actuator element 35. It will be appreciated that the wick 56 should be of a solid, dimensionally stable material so that it will not become deformed when pressed against the underside of the resiliently supported orifice plate 37. Examples of such solid, dimensionally stable wicks 56 are described below.

As can be seen in FIG. 1, the wick 56 extends from inside the liquid reservoir 31 up through the plug 33 in the top of the reservoir 31 to contact the orifice plate 37 and/or the actuator element 35 from near the bottom of the liquid reservoir 31. The wick 56 has longitudinally extending capillary passages which draw liquid up from within the container 31 to the upper end of the wick 56.

The wick 56 is preferably composed of solid, dimensionally stable material, such as a solid, porous plastic material.

In a preferred embodiment the solid, porous plastic material is sold by MicroPore Plastics, Inc. of Stone Mountain, Ga. or the Porex Corporation of Fairburn, Ga. This plastic material is preferably high molecular weight polyethylene, although other materials may be suitable. For other aspects of the invention, wherein the liquid delivery system does not have to be dimensionally stable, pliant wick components, such as wick components made of fabric, yarn, etc., may be used, as will be discussed in more detail below.

The wick 56 preferably includes an integrally formed attachment assembly for securing the wick 56 to the plug 33. Of course, the attachment assembly may be a separate piece affixed to the wick 56. The attachment assembly includes a collar 102 having a lower segment 104 of a relatively large diameter and an upper segment 106 of a relatively small diameter. The top of the lower segment 104 contacts the plug 33 to prevent the wick 56 from moving out of the container 31. The upper segment 106 frictionally fits into the aperture in the plug 33.

As can be seen in FIG. 2, the upper end of the wick 56 enters into an opening in the bottom of the spring housing 39 to supply liquid to a location just below or on the bottom surface of the orifice plate 37. The wick 56 is substantially in contact with a flange portion on the periphery of the domed portion of the orifice plate 37. The wick 56 may also be in contact with the actuator element 35. However, the wick 56 includes a top surface having different levels so that a portion of the wick 56 is not in contact with the orifice plate 37 or the actuator element 35. This portion provides unobstructed passage to the atmosphere.

Figure 3:
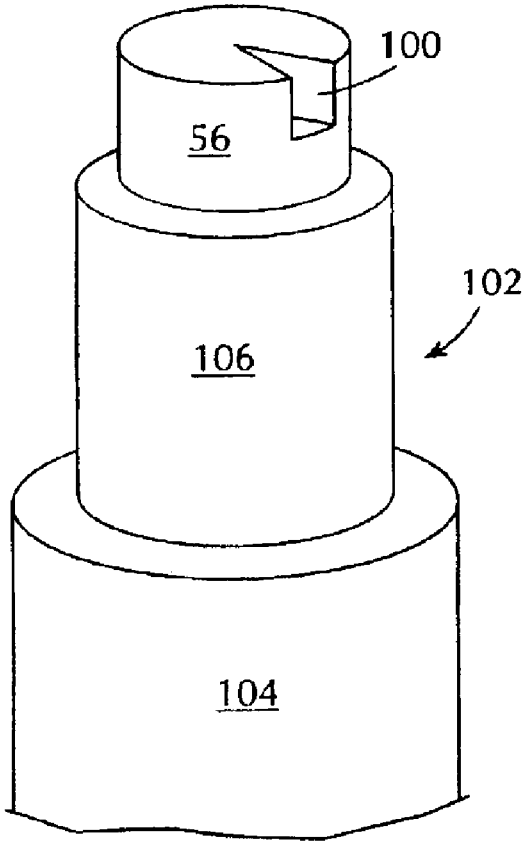
FIG. 3 is a perspective view of the upper portion of a wick that forms part of the replacement reservoir of FIG. 2.
Figure 4:
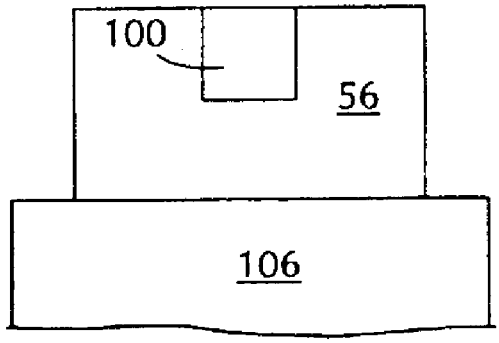
FIG. 4 is an enlarged elevational view of the upper portion of the wick of FIG. 3.
Figure 5:
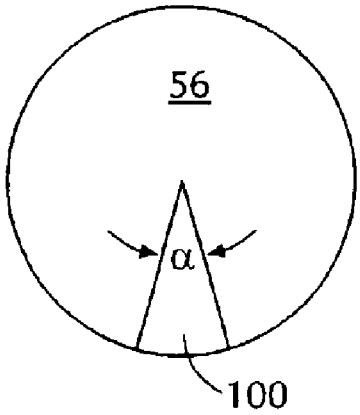
FIG. 5 is a top view of the upper end of the wick of FIG. 3.

As shown in FIG. 3, in one embodiment, the unobstructed passage is provided by way of the top end of the wick 56 including a pie-shaped cutout 100. As seen in FIGS. 4 and 5, the width of the pie-shaped cutout 100 at the periphery of the wick 56 is preferably equal to the depth of the cutout 100. We believe the cutout 100 should preferably be sized so that the volume removed by the cutout 100 is large enough to prevent liquid drawn up by the wick 56 from filling the volume and thereby contacting the orifice plate 37. In other words, the cutout 100 is large enough to form a liquid-free passage.

We have found that an appropriate size for the cutout 100 is achieved when the cutout 100 has a constant depth and defines an angle a (alpha) that is about 10 degrees to about 50 degrees, preferably about 15 degrees to about 30 degrees. Other ranges for the angle a (alpha) include an angle of about 20 degrees to about 40 degrees, or about 23 degrees to about 37 degrees, or about 25 degrees to about 30 degrees. In general, we have found that a smaller angle generates a more constant rate of fluid flow to the orifice plate 37 over time.

Figure 6:
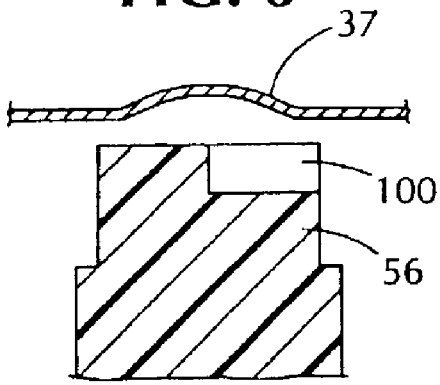
FIGS. 6 and 7 are enlarged elevational views showing the upper end of the wick in cross section as it is being placed in position and after it is in its final position, respectively.
Figure 7:
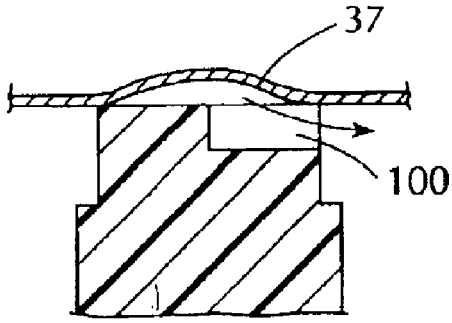

The apparent effect of the cutout 100 is best illustrated with reference to FIGS. 6 and 7. FIG. 6 shows the wick 56 as it is being positioned in the atomization device 20. As the wick 56 moves closer to the orifice plate 37, we believe that there is the potential for air to be trapped between the wet orifice plate 37 and the top surface of the wick 56, which is saturated with fluid from the container 31. However, as shown in FIG. 7, the cutout 100 prevents an air bubble from being trapped, because the air can exit to the atmosphere through the cutout 100 as shown by the arrow.

Figure 8:
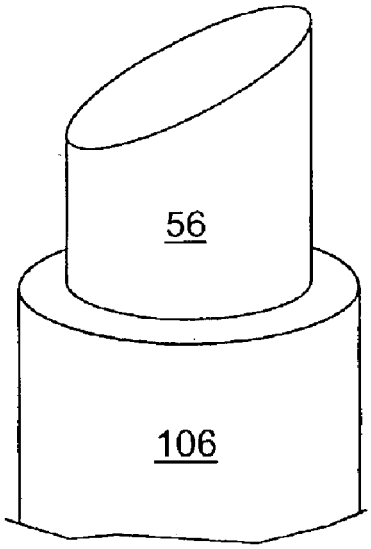
FIGS. 8 to 11 are perspective views of the top ends of wicks forming other embodiments of the invention.

Other embodiments may have a similar effect. For example, as shown in FIG. 8, the top of the wick 56 can be positioned at an angle so that a portion of the top of the wick 56 contacts the orifice plate 37 and a remainder of the top angles away from the orifice plate 37. Alternatively, the atomizer assembly 34 or at least the orifice plate 37 can be tilted with respect to a wick 56 having a horizontal top to obtain the same effect. The top surface of the wick 56 (or the orifice plate 37) should be canted at a sufficient angle so that at least a portion of the space between the top surface of the wick 56 and the orifice plate 37 forms a liquid-free passage. In this embodiment, a portion of the top surface is spaced from the orifice plate 37 in order to form an unobstructed passage for air to escape to the atmosphere.

Figure 9:
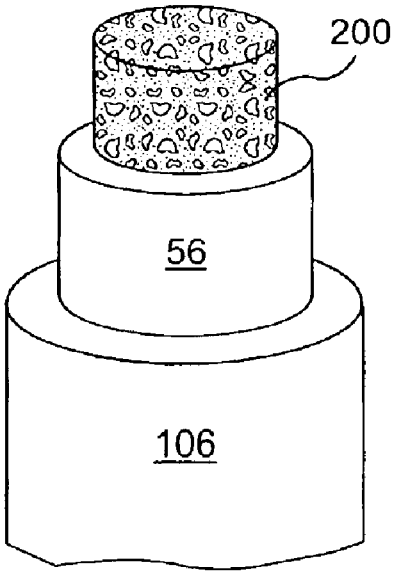

We also conceived other embodiments for the wick 56. As shown in FIG. 9, the wick 56 may have an open-cell, flexible foam 200 embedded therein. Such foam material may comprise polyurethane foam, although other materials may also be used provided the materials are chemically inert with respect to the liquid in the liquid container 31. The foam 200 may be placed substantially concentrically with the wick 56, or it may be offset. Also, the foam 200 may take up the majority of the cross-sectional area of the wick 56, as shown, or it may form only a minor part of such area. The foam 200 may provide a way for air to be absorbed or any liquid remaining on the bottom surface of the orifice plate 37, which may remain after replacement of the reservoir assembly 30, to be broken up, absorbed, or passed through the orifices in the orifice plate 37. This may, therefore, prevent air bubbles from being trapped.

Figure 10:
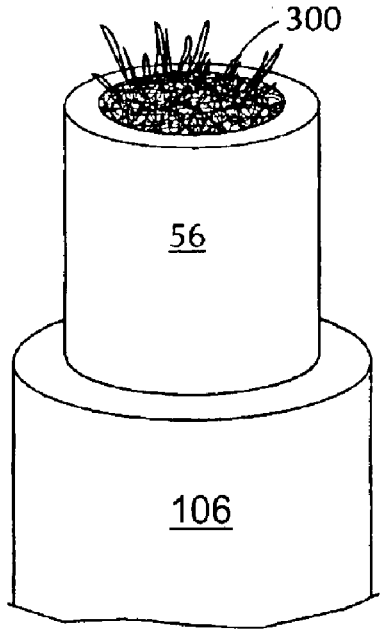

As a further embodiment, shown in FIG. 10, the top of the wick 56 may include an embedded, fibrous material 300. Such fibrous material 300 may comprise nylon, polypropylene, or cotton. Other materials may also be used, provided the materials are chemically inert with respect to the liquid in the liquid container 31. The fibrous material 300 may provide a way for air to be absorbed or any liquid remaining on the bottom surface of the orifice plate 37, which may remain after replacement of the reservoir assembly 30, to be broken up, absorbed, or passed through the orifices in the orifice plate 37. This may, therefore, prevent air bubbles from being trapped.

Figure 11:
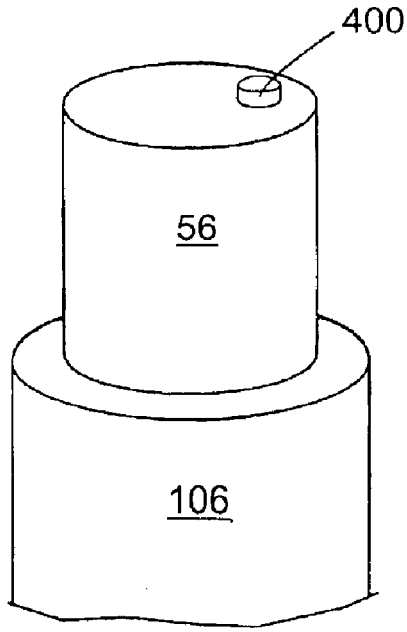

In yet a further embodiment, shown in FIG. 11, the top of the dimensionally stable wick 56 includes a raised dome 400, which is also dimensionally stable. The raised dome 400 may have a cross-sectional area that is substantially smaller than the cross-sectional area of the top of the wick 56, as shown. Alternatively, the raised dome may comprise a larger share of the cross-sectional area of the wick 56. Regardless, portions of the raised dome 400 and/or the wick 56 itself are/is not in contact with the orifice plate 37. For example, the raised dome 400 may contact the flange of the orifice plate 37, thus maintaining the top surface of the wick out of contact with the facing surface of the orifice plate 37. The raised dome 400 may be tall enough to create a liquid-free passage between at least a portion of the top surface of the wick 56 and the orifice plate 37. That is to say, liquid will not travel from at least a part of the top surface of the wick 56 to the orifice plate 37.

The above-described wicks assure an instantaneous and continuous liquid interface, by way of surface tension contact, between the wick 56 and the lower surface of the orifice plate 37. We have found that the cutout 100 is particularly effective.

We believe the wicks 56 according to the preferred embodiments prevent a problem that sometimes occurs when a depleted liquid reservoir assembly 30, which is replaceable as previously mentioned, is discarded and a new liquid reservoir assembly 30 is inserted. At this time, the orifice plate 37 may still be wet from a previous use. Furthermore, an air bubble may be formed as the replacement liquid reservoir assembly 30 is brought into position in the atomization device 20. We believe this air bubble may be rendered impassable by liquid because of the wet orifice plate 37 and the contact of the upper end of the wick 56 with the orifice plate 37, which combine to trap the air bubble. The liquid from the top end of the new wick 56 apparently cannot penetrate through this air bubble.

We believe that if the clear air passage is provided to vent this air bubble, then the entire space between the top of the wick 56 and the underside of the orifice plate 62 can be provided with liquid and the liquid could readily be pumped through the atomization device 20.

Notwithstanding the foregoing, the wicks according to our preferred embodiments may actually operate differently from the operation described above. Nevertheless, we have found that the wicks 56 consistently provide instantaneous flow of liquid, when a replacement reservoir assembly 30 is inserted into the atomizer 20.

Many different embodiments of our invention may be constructed without departing from the spirit and scope of the present invention. It should be understood that our invention is not limited to the specific embodiments described in this specification. To the contrary, our invention is intended to cover various modifications and equivalent arrangements included within the spirit and scope of the invention as hereafter claimed. The scope of the claims is to be accorded the broadest interpretation so as to encompass all such modifications, equivalent structures and functions.

Industrial Applicability

The embodiments described herein provide consistent start up for an atomizer device, so that a liquid stored in a container can be reliably atomized even after the container has been removed and replaced by another.

We claim:

1. A method of positioning an upper end of a solid, dimensionally stable wick having liquid-filled interstices against a surface of a dome-shaped vibratable orifice plate, which has a plurality of minute orifices formed therethrough and is configured to dispense the liquid filling the interstices of the wick as the orifice plate vibrates, said method comprising the step of:

moving the wick toward the dome-shaped vibratable orifice plate while maintaining a passage that extends to the atmosphere from a space created between a top surface of the wick and a concave undersurface of the dome-shaped vibratable orifice plate, as the wick is positioned with a portion of the upper end contacting the orifice plate.

2. A method according to claim 1, wherein said step of moving the wick while maintaining a passage includes providing a cutout in the upper end of the wick, the cutout having side surfaces and a bottom surface, the bottom surface being below a top surface of the wick such that the bottom surface does not contact the vibratory orifice plate, with the cutout defining the passage.

3. A method according to claim 1, wherein said step of moving the wick while maintaining a passage includes providing surfaces in the wick that are configured to provide the unobstructed passage to the atmosphere.

4. A method according to claim 3, wherein the surfaces are formed as a cutout in the upper end of the wick.

5. A method according to claim 4, wherein said step of providing surfaces includes sizing the cutout such that liquid filling the interstices of the wick will not fill the volume removed by the cutout when the wick is positioned against the orifice plate.

6. A method according to claim 5, wherein said sizing step results in the cutout defining an angle of about 10 degrees to about 50 degrees.

7. A method according to claim 5, wherein said sizing step results in the cutout defining an angle of about 15 degrees to about 30 degrees.

8. A method according to claim 1, wherein said step of moving the wick while maintaining a passage includes providing a canted top surface of the wick.

9. An atomizing device, comprising: a replaceable container, which contains a liquid to be atomized;

an elongated wick having a lower end which is immersed in the liquid within said container and an upper end located above said container, the upper end comprising a passage portion; and a dome-shaped vibratory orifice plate, which has a plurality of minute orifices formed through a dome section of said dome-shaped vibratory orifice plate, wherein said dome-shaped vibratory orifice plate comes into contact with the upper end of said wick so as to define a cavity between the upper end of said wick and the dome section of said dome-shaped vibratory orifice plate, such that said passage portion defines a passage in flow communication with the cavity and the atmosphere.

10. A replacement reservoir assembly according to claim 9, wherein said dimensionally stable material is made of high molecular weight polyethylene.

11. A replacement reservoir assembly according to claim 9, wherein said passage portion in the upper end of said wick is defined by a cutout having side surfaces depending from a top surface of said wick and a bottom surface being disposed below the top surface such that the bottom surface does not contact the vibratable orifice plate.

12. A replacement reservoir assembly according to claim 11, wherein said cutout defines an angle of about 10 degrees to about 50 degrees.

13. A replacement reservoir assembly according to claim 11, wherein said cutout defines an angle of about 15 degrees to about 30 degrees.

14. A replacement reservoir assembly according to claim 11, wherein said cutout is sized such that the liquid from said container will not fill the volume removed by said cutout.

15. A replacement reservoir assembly according to claim 9, wherein a top surface of the upper end of said wick includes a raised dome that extends above the top surface of said wick and contacts the orifice plate when the upper end of said wick is positioned against the vibratable orifice plate, with the space between the top surface of said wick and the dome section forming the passage portion.

16. A replacement reservoir assembly according to claim 9, wherein a top surface of the upper end of the wick is canted to form the passage portion between a portion of the top surface and the dome section.

17. A wick according to claim 26, wherein said second material fibrous material embedded in the upper end of said wick.

18. A wick according to claim 17, wherein said fibrous material comprises one of nylon, cotton and polypropylene.

19. A wick according to claim 26, wherein said second material flexible foam embedded in the upper end of said wick.

20. A wick according to claim 26, wherein said first material comprises high molecular weight polyethlene.

21. A replaceable reservoir that contains a liquid to be atomized by an atomizer comprising a dome-shaped vibratory orifice plate, which has a plurality of minute orifices formed through a dome section of the dome-shaped vibrating orifice plate, the dome-shaped vibratory orifice plate being configured to mate with the replaceable reservoir and vibrate to eject the liquid supplied by said replaceable reservoir through the minute orifices, said replaceable reservoir comprising:

a container which contains the liquid; and an elongated wick having a lower end which is immersed in the liquid within said container, and an upper end located above said container, said upper end having a passage portion wherein, when said upper end of said wick is brought into contact with the dome-shaped vibratory orifice plate, to mate therewith, a cavity is formed between said upper end of said wick and the domed section of the dome-shaped vibratory orifice plate, and the passage portion defines a passage in flow communication with the cavity and the atmosphere.

* * * * *

UNITED STATES PATENT AND TRADEMARK OFFICE

CERTIFICATE OF CORRECTION

PATENT NO. : 7,017,829 B2
APPLICATION NO. : 10/412911
DATED : March 28, 2006
INVENTOR(S) : Edward Martens, III et al.

It is certified that error appears in the above-identified patent and that said Letters Patent is hereby corrected as shown below:

COLUMN 8

Lines 54-56 (Claim 17), "A wick according to claim 26, wherein said second materials fibrous material embedded in the upper end of said wick" should read --A wick for use in a replaceable reservoir that contains liquid to be atomized by a vibratory orifice plate, which has a plurality of minute orifices formed therethrough and is configured to dispense the liquid in the reservoir, said wick comprising:

a body portion formed of a first material, which is dimensionally stable and includes capillary passages for drawing a liquid from a lower end to an upper end; and a top portion secured to a top of said body portion, said top portion being formed of a second material different from said first material, wherein said second material is a fibrous material embedded in the upper end of said wick.--

Lines 59-61 (Claim 19), "A wick according to claim 26, wherein said second material flexible foam embedded in the upper end of said wick" should read --A wick for use in a replaceable reservoir that contains liquid to be atomized by a vibratory orifice plate, which has a plurality of minute orifices formed therethrough and is configured to dispense the liquid in the reservoir, said wick comprising:

a body portion formed of a first material, which is dimensionally stable and includes capillary passages for drawing a liquid from a lower end to an upper end; and a top portion secured to a top of said body portion, said top portion being formed of a second material different from said first material, wherein said second material is a flexible foam embedded in the upper end of said wick--

UNITED STATES PATENT AND TRADEMARK OFFICE

CERTIFICATE OF CORRECTION

PATENT NO. : 7,017,829 B2
APPLICATION NO. : 10/412911
DATED : March 28, 2006
INVENTOR(S) : Edward Martens, III et al.

It is certified that error appears in the above-identified patent and that said Letters Patent is hereby corrected as shown below:

COLUMN 8 (cont'd)

Lines 62-63 (Claim 20), "A wick according to claim 26, wherein said first material comprises high molecular weight polyethlene" should read --A wick for use in a replaceable reservoir that contains liquid to be atomized by a vibratory orifice plate, which has a plurality of minute orifices formed therethrough and is configured to dispense the liquid in the reservoir, said wick comprising:

a body portion formed of a first material, which is dimensionally stable and includes capillary passages for drawing a liquid from a lower end to an upper end, wherein said first material comprises high molecular weight polyethylene; and a top portion secured to a top of said body portion, said top portion being formed of a second material different from said first material.--

Signed and Sealed this

Twelfth Day of December, 2006

JON W. DUDAS
*Director of the United States Patent and Trademark Office*